US006746221B1

(12) United States Patent
Havard

(10) Patent No.: US 6,746,221 B1
(45) Date of Patent: Jun. 8, 2004

(54) TRAVELING VALVE FOR SUCKER ROD PUMPS

(76) Inventor: Kenneth Havard, P.O. Box 800103, Houston, TX (US) 77280-0103

( * ) Notice: Subject to any disclaimer, the term of this patent is extended or adjusted under 35 U.S.C. 154(b) by 0 days.

(21) Appl. No.: 10/201,030

(22) Filed: Jul. 23, 2002

(51) Int. Cl.[7] ..... F04B 39/10; F04B 53/00

(52) U.S. Cl. ..... 417/555.2; 417/545; 166/369

(58) Field of Search ..... 417/555.2, 435, 417/554, 545, 547, 552, 448, 498; 166/369, 108, 373, 105.5; 251/121, 176, 231; 137/625.3, 625.33, 625.2

(56) References Cited

U.S. PATENT DOCUMENTS 3,136,256 A * 6/1964 Chenault ..... 103/46
3,215,085 A * 11/1965 Goostree ..... 103/179
3,594,103 A * 7/1971 Hillis ..... 417/435
4,448,427 A * 5/1984 Mashaw, Jr. ..... 277/73
4,662,831 A * 5/1987 Bennett ..... 417/430
4,968,226 A * 11/1990 Brewer ..... 417/435
5,356,114 A * 10/1994 Havard ..... 251/176

* cited by examiner

*Primary Examiner*—Justine R. Yu
*Assistant Examiner*—Han L Liu
(74) *Attorney, Agent, or Firm*—Harrison & Egbert

(57) ABSTRACT

A traveling valve for use in a sucker rod pump having a cylindrical housing having an interior passageway and a tapered shoulder formed therein and a piston received within the interior passageway and slidable therein. The piston has a mechanically operated sliding shear seal positioned interior of the housing. The piston has a surface thereon generally conforming to a shape of the tapered shoulder in the interior passageway. Separate channels extend through the wall of the housing so as to communicate between the interior of the housing and the annulus of the tubing string.

16 Claims, 4 Drawing Sheets

TRAVELING VALVE FOR SUCKER ROD PUMPS

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to fluid pumps for elevating fluids from areas such as subterranean hydrocarbon bearing formations. More particularly, the present invention relates to traveling valves for use on sucker rod pumps. In particular, the present invention relates to such traveling valve having sliding shear seals therein.

BACKGROUND OF THE INVENTION

Conventional oil and gas wells include a cased well bore with a tubing string extending down to the hydrocarbon bearing formation. The casing is perforated at the production level to permit the hydrocarbons to flow into the casing and the bottom of the tubing is generally open to permit the hydrocarbons to flow into the tubing and up to the surface. Oftentimes there is insufficient pressure in a formation to cause oil and other liquids to readily flow to the surface. It therefore becomes necessary to install some type of artificial lift system for pumping fluids to the surface.

One of the most common types of artificial lift systems is a sucker rod pump. This type of pump is positioned in the well at the level of the fluids to be removed and is mechanically driven by a series of rods connecting the pump to a pumping unit at the surface.

A sucker rod pump includes the simple combination of a cylinder or barrel with a piston or plunger and a suitable intake valve and a discharge valve. The intake valve is often referred to as a standing valve and the discharge valve is often referred to as a traveling valve.

Two of the more common types of sucker rod pumps are the tubing pump in which the pump barrel is attached directly to the tubing and is lowered to the bottom of the well as the tubing is run into the well. The plunger is attached to the bottom of the sucker rod and is positioned within the pump barrel. The intake valve is positioned at the bottom of the pump barrel and the traveling valve is positioned on the plunger. The second type of pump is often referred to as an insert pump and the entire assembly is attached to the bottom of the sucker rod. The barrel is held in place by a special seating nipple or other device positioned within the tubing. This type of pump has the advantage that it can more easily be removed for repair or replacement than a tubing pump. However, it suffers from the disadvantage of having a lower fluid capacity.

The operation of a sucker rod pump is relatively simple. The plunger reciprocates up and down in the barrel under the force of the sucker rod. During the upstroke, the traveling valve is closed and the fluid above the plunger is lifted to the surface by the plunger and sucker rod. At the same time, the standing valve is open allowing fluids to flow into and fill the now evacuated barrel. On the downstroke, the standing valve is closed thus trapping the fluids in the barrel. The traveling valve is opened allowing the compressed fluids to flow through the plunger so they can be lifted during the subsequent cycle.

While sucker rod pumps have been in use for decades and have proven to be economical and reliable, they still experience certain shortcomings and problems. Some of these problems are associated with valves which are generally of the ball-and-seat variety. This type of valve is opened and closed by pressure differentials across the valve.

One problem that is often encountered is referred to as gas lock. This occurs when there is a substantial amount of gas that flows into the pump with the liquid. Because of the high compressibility of the gas, insufficient pressure is generated during the downstroke of the pump to open the traveling valve against the hydrostatic pressure of the fluid in the production tubing. Accordingly, the pump can repeatedly cycle without any fluid being lifted to the surface.

Fluid pound is another problem that is often encountered. If the barrel is only partially filled with liquid the plunger forcefully encounters the liquid level part way through the downstroke thus causing severe stress to be placed on the pump. Pump off damage also occurs when the barrel is not completely filled with fluid. Damage occurs in the wall of the working barrel due to overheating of the pump which is caused by the absence of fluid to carry away the heat created by friction in the pump.

The problems associated with such traveling valves was addressed in U.S. Pat. No. 5,356,114, issued on Oct. 18, 1994, to the present inventor. This patent describes a mechanically operated traveling valve for use in a sucker rod pump. The valve included a cylindrical housing, a base positioned in the bottom of the housing which contains a first position of a sliding shear seal and a piston positioned within the housing of the base which contains a second position of the sliding shear seal. The valve is operable between open and closed positions by reciprocal actions on the piston which opens and closes the sliding shear seal.

Although this invention presented a very effective traveling valve which avoided the problems of the prior art, experiments involving this device showed that further problems were encountered. Most importantly, the enormous forces resulting between the surface on the piston which contacts the shoulder in the housing resulted in a fracturing of the shaft associated with the piston. Although various theories were developed as to why the shaft fractured as it did, it is believed that the two main reasons for such fracturing resulted from the flat surface-on-surface contact between the shoulder of the housing and the surface of the piston and the asymmetrical configuration of the cross-section of the piston in this area. Because of the asymmetrical cross-section, a bending moment occurred every time there was contact between the housing and the piston. Ultimately, after repeated use, this bending moment would tend to fracture this structure of the shaft. Whenever these fractures would occur, replacement of the traveling valve would be required. Such frequent replacements of the traveling valve resulted in enormous costs to the pump operator. Additionally, it was found that the shape of the piston in the area of the opening corresponding to the aperture in the housing would allow a limited amount of fluid flow through the housing, through the aperture and into the tubing string. However, the maximum area of fluid flow was restricted by the size of the diameter of the piston and the inner wall of the housing. As such, it would be desirable to maximize the area through which the fluid could flow into the tubing string.

It is an object of the present invention to provide a traveling valve which maximizes the operating life of the traveling valve.

It is another object of the present invention to provide a traveling valve which minimizes fractures to the shaft associated with the piston.

It is another object of the present invention to provide a traveling valve which maximizes fluid flow from the piston into the tubing string.

It is a further object of the present invention to provide a traveling valve which is relatively inexpensive, easy to manufacture, and easy to use.

These and other objects and advantages of the present invention will become apparent from a reading of the attached specification and appended claims.

BRIEF SUMMARY OF THE INVENTION

The present invention is a traveling valve for use in a sucker rod pump comprising a cylindrical housing having an interior passageway and a piston received within the interior passageway and slidable therein. The housing has its interior passageway extending from an upper end thereof to a bottom end thereof. The interior passageway has a tapered shoulder formed therein. The piston has a mechanically operated sliding shear seal positioned interior of the housing. This seal is operable between open and closed positions by the reciprocal action of the sucker rod. The piston has a surface thereon generally conforming to a shape of the tapered surface in the interior passageway.

In the present invention, the piston is movable between a first position and a second position. The seal is opened when the piston is in the first position. The seal is closed when the piston is in the second position. The surface of the piston is proximal the tapered shoulder of the housing when in the second position.

In the present invention, a tubing has the housing and the piston interior thereof. The tubing defines an annulus between an inner wall thereof and an exterior of said housing. The housing has an aperture formed therein. The piston is in fluid communication with the annulus through the aperture when the piston is in the first position. The housing has a first channel extending through a wall thereof so as to communicate between the annulus and the interior passageway adjacent a top of the tapered shoulder. The housing also has a second channel extending through a wall thereof so as to communicate between the annulus and the interior passageway in a location below the tapered shoulder.

In the preferred embodiment of the present invention, the tapered shoulder has a frustoconical configuration. The surface of the piston has a frustoconical shape matching the frustoconical configuration of the tapered shoulder.

The piston has a smaller diameter adjacent to the opening corresponding to the aperture of the housing when the piston is in the first position.

The present invention includes a base which is threadedly connected to the lower end of the housing. This base includes a first semi-cylindrical portion positioned within the housing and containing a portion of the sliding shear seal. The piston is positioned within the housing above the base with a shaft extending through the upper end of said housing. The piston includes a second semi-cylindrical portion which matingly engages a first semi-cylindrical portion of the base and contains a second portion of the sliding shear seal. A first passageway extends substantially through the length of the base with a first end in the bottom of the base forming the inlet to the traveling valve and a second end positioned in a longitudinal planar surface of the first semi-cylindrical portion forming an opening in the sliding shear seal. An aperture extends through the second cylindrical portion of the piston. This aperture is in alignment with the second end of the first passageway when the valve is in the opened position. A plate is positioned in a longitudinal planar surface of a first semi-cylindrical portion. This plate has an aperture formed therein corresponding to the first passageway. A disk positioned within a recess of a longitudinal planar surface of the semi-cylindrical portion of the piston. This disk is aligned such that it occludes the aperture in the plate when the valve of the closed position.

DETAILED DESCRIPTION OF THE INVENTION

The present invention provides a mechanically operated traveling valve assembly for use with sucker rod pumps. The valve assembly associated with the present invention eliminates the problems of gas lock, fluid pound and pump off damage that are often associated with conventional ball-and-seal type traveling valves. Additionally, since the traveling valve is mechanically operated, it can be used in any given attitude making it an excellent application for horizontal or deviated wells. Additionally, the structure of the present invention allows the traveling valve to withstand the strong forces imparted thereto over lengthy periods of time so as to enhance the operative life of the traveling valve.

Figure 1:
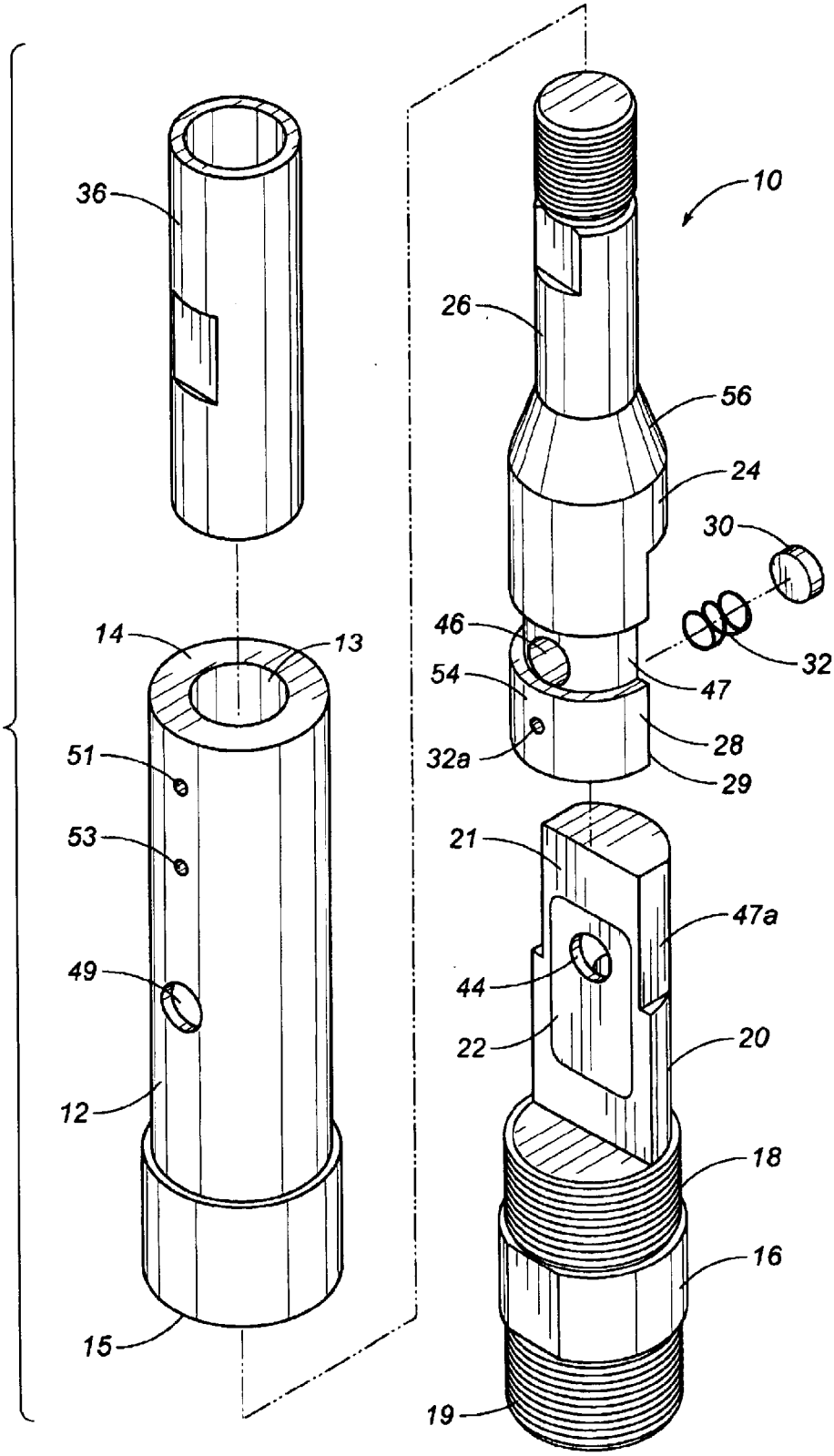
FIG. 1 is an exploded perspective view of the preferred embodiment of the present invention.

FIG. 1 illustrates an exploded perspective view of a preferred embodiment of the traveling valve 10 of the present invention generally designated at 10. Valve 10 includes a cylindrical housing 12 having an upper end 14 and a lower end 15.

A base 16 having threads 18 is threadedly connected into the lower end 15 of housing 12. Base 16 includes a semi-cylindrical portion 20 on the top thereof with a longitudinal planar surface 21 to form a portion of a sliding shear seal. A tungsten carbide plate 22 having an aperture 44 is placed within the longitudinal planar surface 21 of the semi-cylindrical portion 20 such that the surface of the plate is flush with the surface of the semi-cylindrical portion 20. Plate 22 is secured in place by brazing or any other suitable means to hold it in place and provide a fluid-tight seal between plate 22 and base 16. Base 16 also includes threads 19 to connect valve 10 to the top of a conventional plunger in a sucker rod pump.

A piston 24 is positioned within housing 12 above base 16. Piston 24 includes a shaft 26 which extends through aperture 13 in the upper end 14 of housing 12.

Piston 24 also includes a semi-cylindrical portion 28 on the bottom thereof with a longitudinal planar surface 29 which matingly engages semi-cylindrical portion 20 to form the other half of the sliding shear seal. A tungsten carbide disk 30 and a spring 32 are placed within a recess 34 (see FIG. 2) in semi-cylindrical portion 28. Disk 30 engages plate 22 to form the remainder of the sliding shear seal. A hole 32*a* is formed through semi-cylindrical portion 28 so as to allow hydrostatic pressure to act on the disk 30.

While the preferred embodiment uses a tungsten carbide plate and a tungsten carbide disk to form portions of the sliding shear seal, it will be appreciated by those skilled in the art that other abrasion resistant materials could also be used. For example, ceramics and various metals can be used depending on the environment in which the pump will be used.

Valve 10 also includes a coupling 36 which is threadedly connected to the top of shaft 26 on piston 24. Coupling 36 can then be interconnected to a sucker rod. Accordingly, valve 10 is mechanically operated between open and closed positions by the reciprocal action of the sucker rod on piston 24.

Importantly, in FIG. 1, it can be seen that the piston 24 has a generally frustoconically shaped area 56 thereon. Additionally, aperture 46 is formed through the wall of the semi-cylindrical portion 28 of piston 24. It can be seen that a section 47 is formed in the area corresponding to aperture 46 of lesser diameter than the diameter of the piston 24. This area of lesser diameter 46 allows fluids to flow outwardly of the aperture 46, therearound and outwardly of the housing 12 through aperture 49. Small channels 51 and 53 are formed through the wall of housing 12 so as to allow fluids in the annulus of the tubing string to flow toward the frustoconically-shaped surface 56 at the top of piston 24. There is also a cutout area 47*a* formed on the semi-cylindrical portion 20 in an area corresponding to section 47 on semi-cylindrical portion 28.

When valve 10 is in the open position, an aperture 46 in the semi-cylindrical portion 28 of piston 24 is aligned with aperture 44 in plate 22 to allow the fluid to flow through the sliding shear seal. The fluid then flows through section 47 around piston 24 within housing 12. Section 47 is formed on a side of piston 24 opposite the longitudinal planar surface 21 on semicylindrical portion 20. The fluid can then pass through a passageway 49 toward the production tubing.

Figure 4:
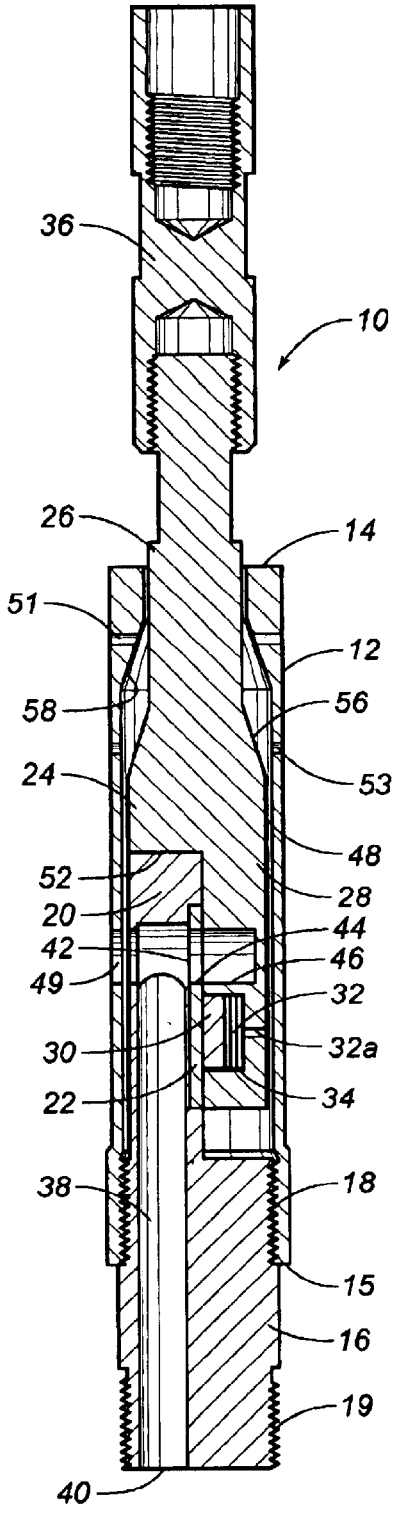
FIG. 4 is a cross-sectional view showing the traveling valve of the present invention in an open position.
Figure 5:
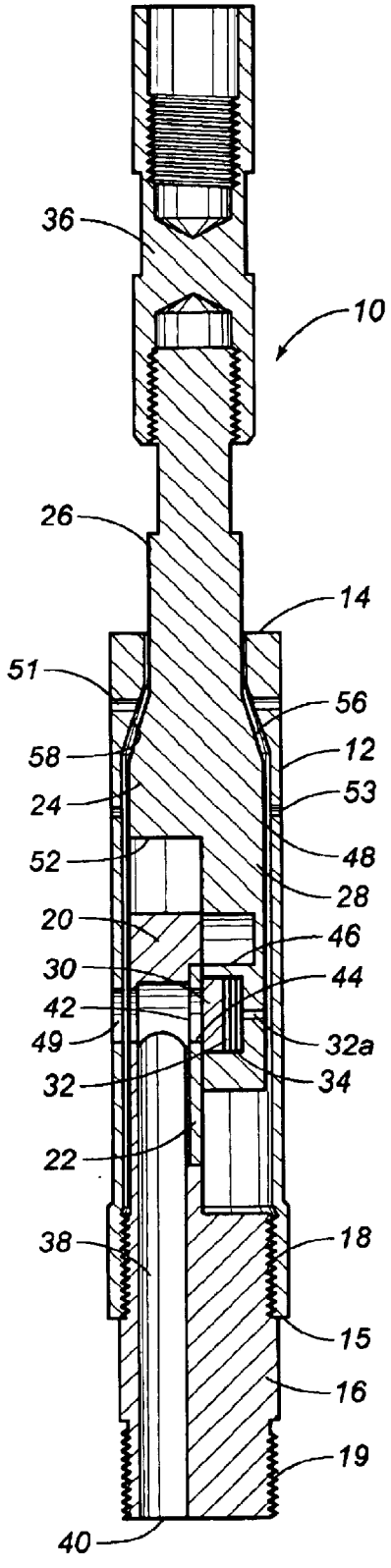
FIG. 5 is a cross-sectional view of the traveling valve of the present invention showing the traveling valve in a closed position.

FIGS. 4 and 5 show longitudinal cross-sectional views of valve 10 in its open and closed positions, respectively.

Base 16 includes a passageway 38 extending substantially through the length thereof Passageway 38 includes a first opening 40 in the bottom of base 16 to permit fluids to flow into valve 10. Passageway 38 includes a second opening 42 facing longitudinal planar surface 21 which permits the fluid to flow through aperture 44 in carbide plate 22.

When valve 10 is in the open position, an aperture 46 in semi-cylindrical portion 28 of piston 24 is aligned with aperture 44 in plate 22 to allow the fluid to flow through the sliding shear seal. The fluid then flows through a section 47 around piston 24 within housing 12. Section 47 is formed on a side of piston 24 opposite the longitudinal planar surface 21 on semicylindrical portion 20. The fluid can then pass through passageway 49 and toward the production tubing.

Additionally, it is important to realize that the fluid can flow through aperture 46 outwardly of the housing 12 through aperture 49 and into the annulus of the tubing string. Piston 24 has a surface 56 which will move relative to the frustoconically-shaped tapered surface 58 on the interior of the housing 12. As can be seen in FIG. 4, when the piston 24 is on the downstroke, surface 56 will be spaced from the frustoconically-tapered surface 58 on the interior of housing 12. In FIG. 5, it can be seen that, on the upstroke of the piston 24, the surface 56 of the piston 24 will be proximal the tapered surface 58 on the interior of housing 12. Importantly, fluid channels 51 and 53 are provided through the wall of the housing 12. As such, on the downstroke, as shown in FIG. 4, fluid will be drawn through the channels 51 and 53 and into the space between the exterior surface of the piston 24 and the inner wall of the housing 12. On the upstroke, the fluid that has gathered in this space will be expelled through the openings 53 and 51. It is important to note that because of the reduced size openings associated with channels 51 and 53, the fluid will be suitably compressed so as to flow outwardly therefrom on the upstroke of piston 24. As a result, the present invention provides a fluid-dampening effect against any shocks that might be imparted between the surface 26 of piston 24 and the surface 58 on the interior wall of the housing 12. It has been found that this fluid-dampening effect will greatly prolong the life of the traveling valve 10 of the present invention. Additionally, and furthermore, it can be seen that the exterior surface of the piston 24, adjacent to the top end thereof, is symmetrically shaped. The surface 56 will taper around the entire outer diameter of the piston 24 in the area of its contact with the surface 58 of housing 12. As a result, any bending moments associated with the strong physical contact between these surfaces during pumping action will be avoided. Once again, this is believed to prolong the lift of the traveling valve 10 of the present invention.

When traveling valve 10 goes from the open position illustrated in FIG. 4 to the closed position illustrated in FIG. 5, disk 30 slides along plate 22 until it occludes aperture 44 in plate 22. Disk 30 is urged against plate 22 to create a fluid tight seal by spring 32 by hydrostatic pressure of fluid above disk 30 through aperture 54 which places recess 34 in fluid communications with passageway 48.

When valve 10 is in closed position, a surface 56 on piston 24 engages a tapered shoulder 58 in the upper end of housing 12. The abutment of surface 56 with shoulder 58 positions disk 30 with plate 22 such that disk 30 occludes aperture 44. Disk 30 is larger in diameter than aperture 44. Additionally, the abutment of surface 56 with shoulder 58 transmits the force of the sucker rod during the upstroke to the remainder of valve 10 thus causing it to rise within the production tubing.

As the sucker rod begins its downstroke, the downward movement of piston 24 mechanically opens the sliding shear seal as disk 30 slides along plate 22 This allows any gas within the pump to escape through valve 10 and be replaced with fluid above valve 10. This eliminates gas lock within the pump and reduces fluid pound and pump off by filling the barrel of the pump with fluid.

Figure 2:
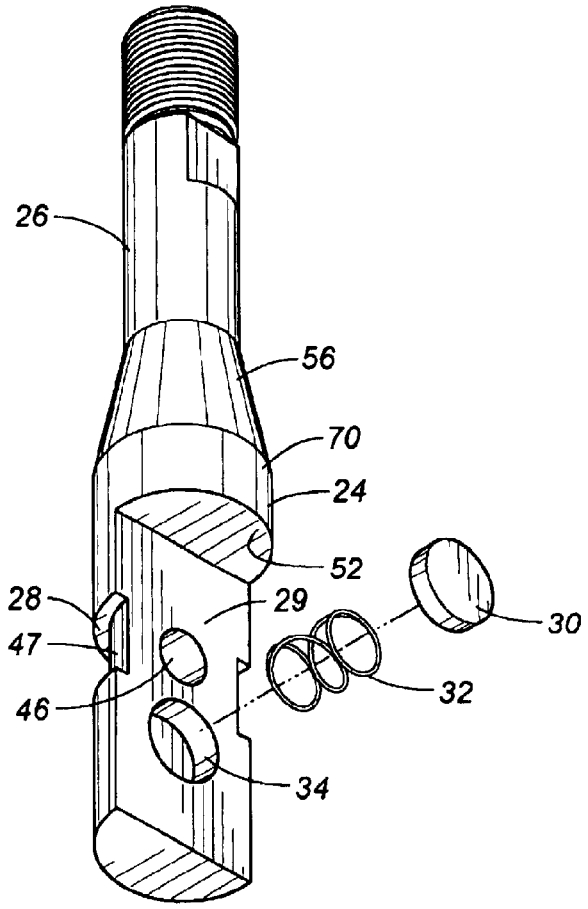
FIG. 2 is a detailed illustration of the piston as used within the apparatus of the present invention.
Figure 3:
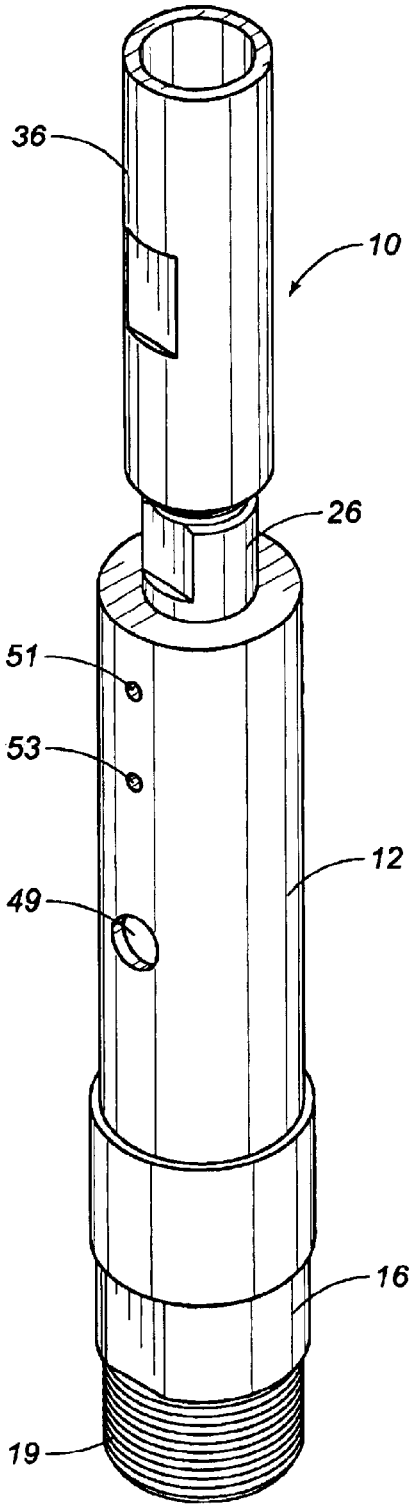
FIG. 3 is a perspective view of the assembled traveling valve of the present invention.

In FIG. 3, it can be seen that there is a section 47 of reduced diameter on the piston 24. One of the problems associated with the prior art was the inability to fully flow the fluid outwardly of aperture 46 during the downstroke. By providing reduced diameter areas 47 and 47*a* around the aperture 46, fluid will be free to flow outwardly therethrough and therearound so that the fluid can exit aperture 49 in the housing 42 or other apertures formed around the housing 12 at the same level as aperture 49. As such, it is not necessary for the present invention to pass the fluid outwardly in the small spaces between the piston 24 and the inner wall of the housing 12. FIG. 2 also shows the configuration of the disk 30 as positioned within the recess 34. Tapered surface 56 is illustrated as formed above a generally circular cross-sectioned area 70 on the piston 24.

FIG. 3 particularly illustrates the assembly of the traveling valve 10 of the present invention. In particular, in FIG. 3, it can be seen that the aperture 49 is formed through the wall of the housing 12. Similarly, channels 51 and 53 will also extend through the wall of housing 12. Importantly, in the present invention, and as shown in FIGS. 4 and 5, multiple channels 51 and 53 can be formed through the walls of the housing 12 at the same level as those illustrated in FIG. 3. Similarly, additional apertures 49 can also be formed through the wall of the housing 12 at the same level as aperture 49 illustrated in FIG. 3. FIG. 3 also shows the coupling 36 as secured to the threaded end of the shaft 26 of piston 24.

Figure 6:
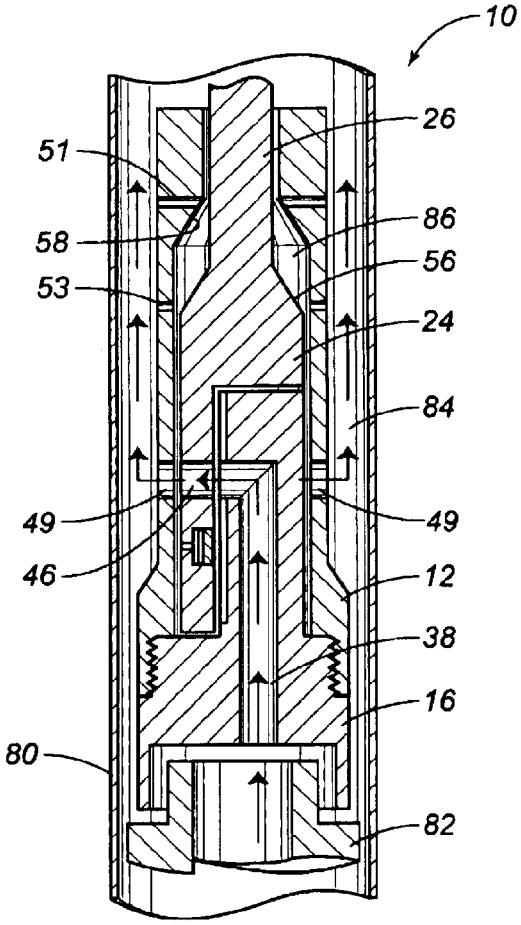
FIG. 6 is a diagrammatic illustration of the operation of the present invention on the downstroke of the sucker rod.

FIG. 6 shows the operation of the traveling valve 10 of the present invention in its position within working barrel 80. In particular, annulus 84 is formed between the inner wall of the working barrel 80 and the outer surface of the housing 12. Housing 12 is illustrated as having apertures 49 formed on opposite sides thereof. The base 16 is particularly illustrated in threaded engagement with the lower end of the housing 12.

The piston 24 is illustrated with its aperture 46 aligned with the aperture 49 of housing 12. Similarly, the passageway 38 in the base 16 will correspondingly align with the aperture 46 in the piston 24. In this downstroke position, fluid from the annulus 84 will fill the space 86 between the outer surface of the piston 24 and the inner wall of the passageway associated with housing 12. The filling of the space 86 is caused by the flow of fluid drawn through the channels 51 and 53 by the downward suction action created by the piston 24 on its downstroke. In FIG. 6, it can be seen that fluid will flow upwardly through the annulus 84 of the working barrel 80 to a top surface location.

Figure 7:
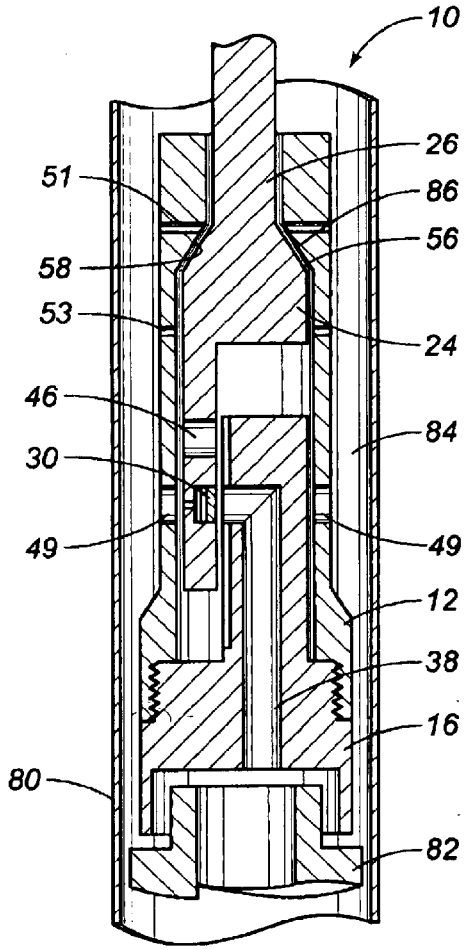
FIG. 7 is a diagrammatic illustration of the operation of the present invention with the sucker rod on the upstroke.

FIG. 7 illustrates the piston 24 in its upstroke position. In the position illustrated in FIG. 7, the traveling valve 10 of the present invention will be closed so as to lift fluid above the plunger 82. In particular, it can be seen that the aperture 46 on the piston 24 has moved out of alignment with the aperture associated with fluid passageway 38 in the base 16. Simultaneously, disk 30 is moved in position by the spring 32 so as to be juxtaposed against the opening of the aperture associated with fluid passageway 38. As a result, upward fluid flow through the passageway 38 is prevented and, similarly, downward fluid flow through the aperture 49 in the housing 12 is also prevented. Hydrostatic pressure action through the aperture 49 and upon the surface of the disk 30 will further assure the sealing of the passageway 38.

Importantly, on the upstroke, it can be seen that the frustoconical-shaped surface 56 is juxtaposed against the frustoconically configured shoulder 58 on the interior passageway of the housing 12. As the shaft 26 and its associated piston 24 move upwardly within the interior passageway of the housing 12, fluid in the space 86 will be forced outwardly through the channels 51 and 53. Because of the restricted orifices created by the channels 51 and 53, the fluid within the space 86 will act so as to provide hydraulic cushioning to the contact between the surface 56 and the surface 58. As a result, the shock forces created by severe contacts in the shoulder-to-shoulder contacts between the surfaces is minimized and cushioned. Similarly, since the frustoconical-shaped surface 56 on the piston 64 is symmetrically shaped in cross-section, there will be no bending moments associated with the contact between the surface 58 and the surface 56.

While the principal use of the present invention is in oil wells, it is also designed to remove liquids, such as water, from gas wells. The fluids are removed in the tubing and the gases produced of the casing. The ability of the valve to eliminate gas lock, fluid pound and pump off damage makes it ideal for this application.

The foregoing disclosure and description of the invention is illustrative and explanatory thereof. Various changes in the details of the illustrated configuration can be made within the scope of the appended claims without departing from the true spirit of the invention. The present invention should only be limited by the following claims and their legal equivalents.

I claim:

1. A traveling valve for use in a sucker rod pump comprising:

a cylindrical housing having an interior passageway extending from an upper end to a bottom end thereof, said interior passageway having a tapered shoulder formed therein;

a piston received within said interior passageway of said housing and slidable therein, said piston having a mechanically operated sliding shear seal positioned interior of said housing, said seal being operable between an open position and a closed position by reciprocal action of the sucker rod, said piston having a surface thereon generally conforming to a shape of said tapered shoulder in said interior passageway; and a base threadedly connected to a lower end of said housing, said base including a first semi-cylindrical portion positioned within said housing and containing a portion of said sliding shear seal, said piston positioned within said housing above said base with a shaft extending through said upper end of said housing, said piston including a second semi-cylindrical portion which matingly engages said first semi-cylindrical portion of said base and contains a second portion of said sliding shear seal.

2. The traveling valve of claim 1, said piston being movable between a first position and a second position, said seal being in said open position when said piston is in said first position, said seal being in said closed position when said piston is in said second position, said surface of said piston being proximal said tapered shoulder of said housing when in said second position.

3. The traveling valve of claim 2, further comprising:

a tubing having said housing and said piston interior thereof, said tubing defining an annulus between an inner wall thereof and an exterior of said housing.

4. The traveling valve of claim 3, said housing having an aperture formed therein, said piston having a fluid passageway communicating with said annulus through said aperture when said piston is in said first position.

5. The traveling valve of claim 4, said piston having a smaller diameter at an opening corresponding to said aperture than a diameter of a remainder of said piston.

6. The traveling valve of claim 3, said housing having a first channel extending through a wall thereof so as to communicate between said annulus and said interior passageway adjacent a top of said tapered shoulder.

7. The traveling valve of claim 6, said housing having a second channel extending through a wall thereof so as to communicate between said annulus and said interior passageway in a location below said tapered shoulder.

8. The traveling valve of claim 1, said tapered shoulder having a frustoconical configuration, said surface of said piston having a frustoconical shape matching said frustoconical configuration of said tapered shoulder.

9. The traveling valve of claim 1, said base having a first passageway extending substantially therethrough and having a first end in the bottom of the base forming an inlet to said housing and a second end positioned in a longitudinal planar surface of said first semi-cylindrical portion so as to form an opening in said sliding shear seal.

10. The traveling valve of claim 9, further comprising:

a plate positioned in longitudinal planar surface of said first semi-cylindrical portion, said plate having an aperture formed therein corresponding to said second end of said first passageway.

11. The traveling valve of claim 10, further comprising:

a disk positioned within a recess of a longitudinal planar surface of said semi-cylindrical portion of said piston, said disk being aligned and positioned so as to occlude said aperture in said plate when said valve is in said closed position.

12. A traveling valve apparatus for use in a sucker rod pump comprising:

a working barrel;

a cylindrical housing positioned within said working barrel so as to define an annulus within an inner wall of said working barrel and an outer wall of said housing, said housing having an interior passageway extending from an upper end to a bottom end thereof, said housing having an interior stop surface formed adjacent a top end thereof, said cylindrical housing having a first channel formed through a wall thereof so as to communicate between said annulus and said interior passageway adjacent said stop surface; and a piston received within said interior passageway of said housing and slidable therein, said piston having a mechanically operated sliding shear seal positioned interior of said housing, said seal being operable between an open position and a closed position by reciprocal action of the sucker rod, said piston being movable between a first position and a second position, said seal being in said open position when said piston is in said first position, said seal being in said closed position when said piston is in said second position, said surface of said piston being proximal said stop surface of said housing when in said second position, said housing having an aperture formed therein, said piston having a fluid passageway communicating with said annulus through said aperture when said piston is in said first position, said piston having an aperture aligned with said aperture of said housing when said piston is in said first position, said piston having a smaller diameter at said aperture of said piston than a diameter of said remainder of said piston below said aperture of said piston.

13. The apparatus of claim 12, said piston having a surface conforming to a shape of said interior stop surface of said cylindrical housing.

14. The apparatus of claim 13, said piston having a surface thereon generally conforming to a shape of said interior stop surface of said housing.

15. The apparatus of claim 14, said stop surface having a frustoconical configuration, said surface of said piston having a mating frustoconical shape.

16. The apparatus of claim 12, said housing having a second channel formed through a wall thereof so as to communicate between said annulus and said interior passageway at a distance spaced below said stop surface.

* * * * *